United States Patent [19]

Sheridan

[11] 3,984,700

[45] Oct. 5, 1976

[54] LIGHT SWITCH TIMER SYSTEM FOR POWER CIRCUIT HAVING MANUAL AND ELECTRICAL CONTROLLERS

[75] Inventor: Dennis J. Sheridan, Mineola, N.Y.

[73] Assignee: Lawrence Peska Associates, Inc., New York, N.Y. ; a part interest

[22] Filed: Oct. 30, 1974

[21] Appl. No.: 519,129

[52] U.S. Cl. ..... 307/139; 200/33 R; 200/35 R; 200/38 A

[51] Int. Cl.[2] ..... H01H 43/00

[58] Field of Search ..... 200/33–39, 200/329–331; 174/52 R, 53, 55; 307/139, 141, 141.4, 141.8; 335/63–67

[56] References Cited

UNITED STATES PATENTS

| | | | |
|---|---|---|---|
| 2,193,740 | 3/1940 | Reed | 174/55 X |
| 2,905,776 | 9/1959 | Eisenberg et al. | 200/37 R |
| 2,937,247 | 5/1960 | Laviana et al. | 200/38 A |
| 3,179,758 | 4/1965 | Trock | 200/33 R X |
| 3,818,156 | 6/1974 | Augustyniak | 200/33 R |
| 3,819,885 | 6/1974 | Moroto et al. | 200/33 R X |

FOREIGN PATENTS OR APPLICATIONS

| | | | |
|---|---|---|---|
| 1,224,592 | 3/1971 | United Kingdom | 200/38 F |

*Primary Examiner*—James R. Scott
*Attorney, Agent, or Firm*—Jack D. Slobod

[57] ABSTRACT

An electrical switch timer device is used to turn off an electrical light, wherein the light switch timer device communicates with a conventional wall toggle switch. The electrical timing device comprises an electrical circuit consisting of a combination of a toggle switch wired in series to a parallel circuit of an electrical timer clock motor and an electrical light, wherein the combination is wired in parallel to a series circuit of a timer clock switch and an electromagnet. The electromagnet communicates with the toggle switch.

2 Claims, 7 Drawing Figures

LIGHT SWITCH TIMER SYSTEM FOR POWER CIRCUIT HAVING MANUAL AND ELECTRICAL CONTROLLERS

SUMMARY OF THE INVENTION

My invention relates to a unique and novel improvement in electrical timing device used for turning off and on electric apparatii.

It is an object of my invention to provide an electrical timing device simple in design and of low manufacturing cost.

It is a further advantage of my invention to provide an electrical timing device as a replacement unit for a standard wall toggle switch.

It is a still further object of my invention to provide a positive electromechanical means of opening and closing the circuit.

Another object of my invention is to provide a means of resetting the timer clock without the movement of the clock hand.

Another object of my invention is to provide an electrical timing device capable of being easily used by an unskilled person.

Briefly, my present invention comprises an electrical switch timer device used to turn off an electrical light, wherein the light switch timer device communicates with a conventional wall toggle switch. The electrical timing device comprises an electrical circuit consisting of a combination of a toggle switch wired in series to a parallel circuit of an electrical timer clock motor and an electrical light, wherein the combination is wired in parallel to a series circuit of a timer clock switch and an electromagnet. The electromagnet contained in the housing of the toggle switch communicates mechanically by magnetic means with the spring assembly of the toggle switch. The timer clock switch comprises the electrical engagement of a reference hand and a clock hand of the timer clock.

BRIEF DESCRIPTION OF THE DRAWING

The objects and features of the invention may be understood with reference to the following detailed description of an illustrative embodiment of the invention, taken together with the accompanying drawings in which.

DESCRIPTION OF THE PREFERRED EMBODIMENT

Figure 1:
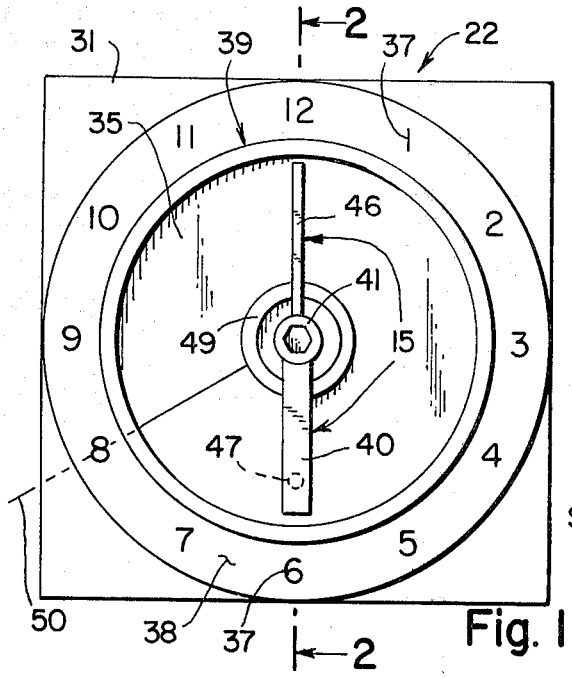
FIG. 1 illustrates a front view of the electrical time clock.
Figure 2:
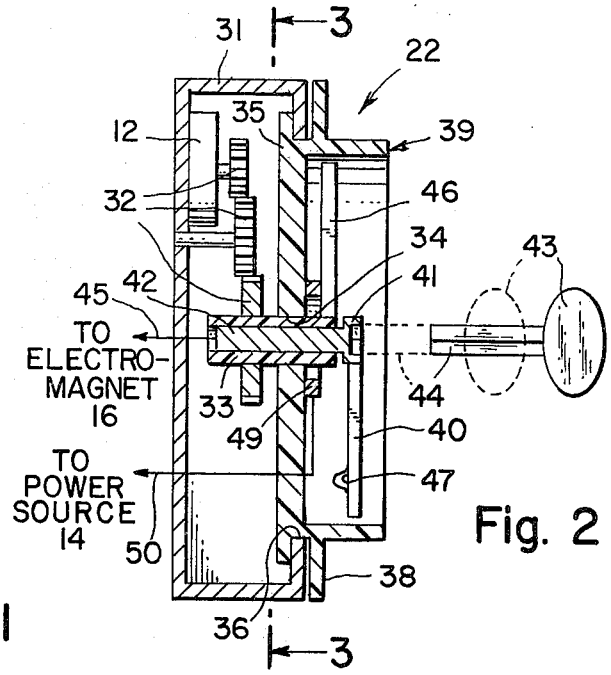
FIG. 2 illustrates a side cross sectional view of the electrical timer clock.
Figure 3:
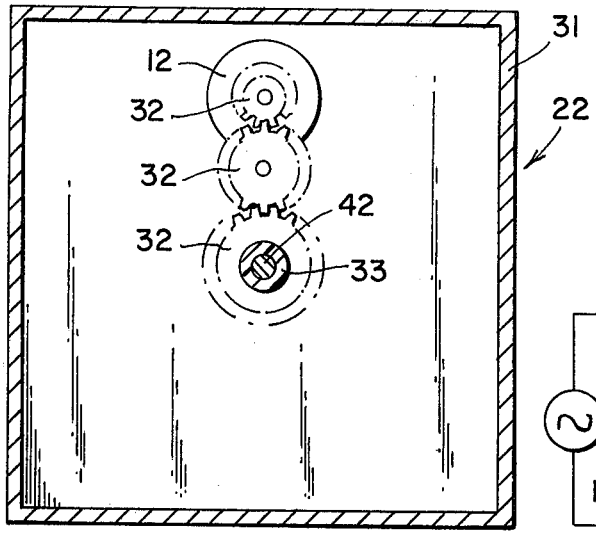
FIG. 3 illustrates a front cross-sectional view of the electrical timer clock.
Figure 4:
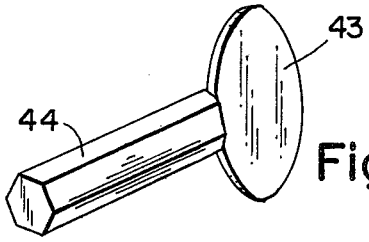
FIG. 4 illustrates a perspective view of the key of the invention.
Figure 5:
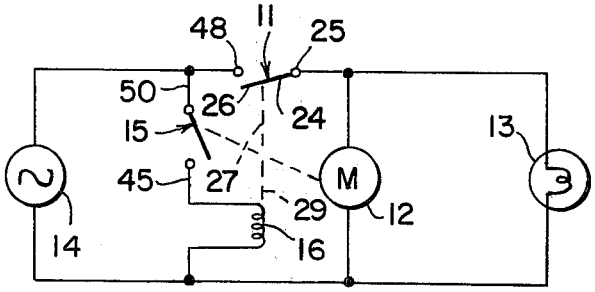
FIG. 5 illustrates an electrical schematic diagram of the electrical timer switch device.
Figure 6:
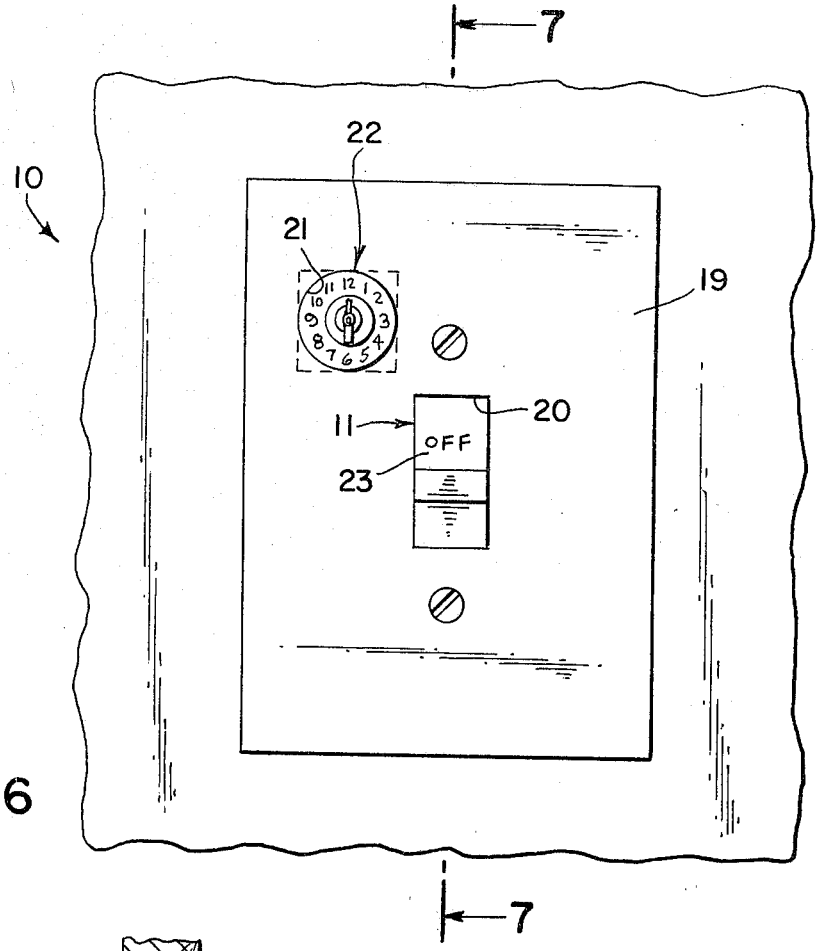
FIG. 6 illustrates a front view of the electrical timer switch device.
Figure 7:
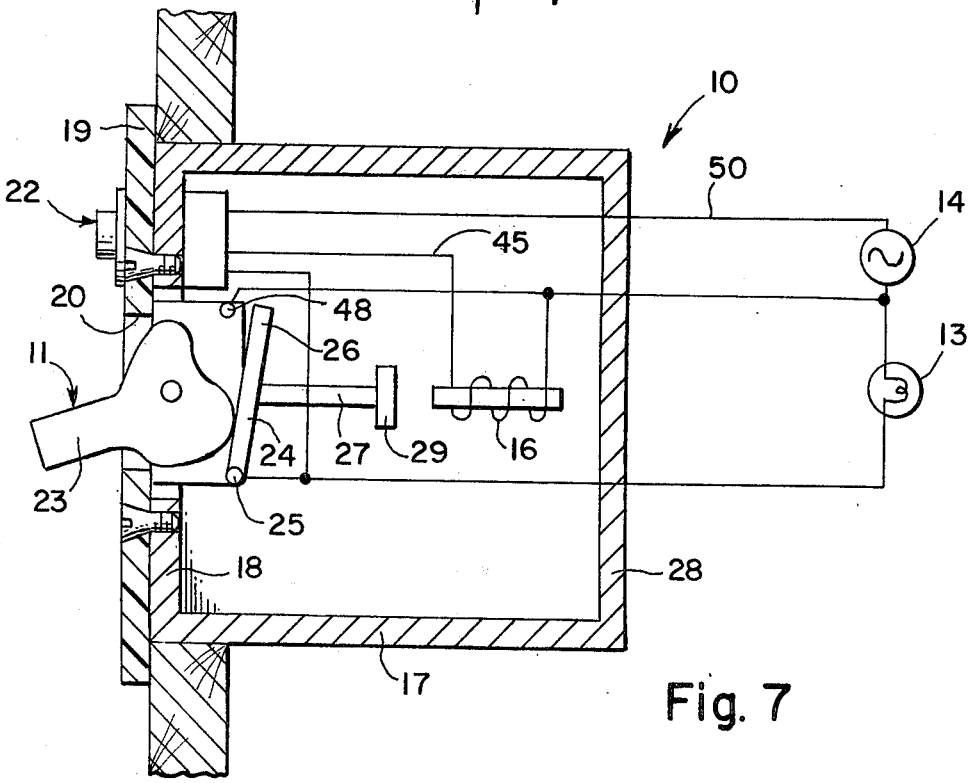
FIG. 7 illustrates a side cross-sectional view of the electrical timer switch device.

Turning now descriptively to the drawings, in which similar reference characters denote similar elements throughout the several views, FIGS. 6–7 show an electrical timing device 10 used to turn an electric toggle switch 11 off and on. The electric timing device comprises an electric circuit as shown in FIG. 5 consisting of a combination of a toggle switch 11 wired in series to a parallel circuit of an electrical timer clock motor 22 and an electric light 13, wherein the aforementioned combination is wired in parallel to a of a power source 14, and a series combination of a timer clock switch 15, and an electromagnet 16. The electromagnet 16 mechanically communicates with a flat conductive spring element 24 of toggle switch 11. FIGS. 6, 7 show a generally hollow rectangular shaped housing 17 having an open longitudinal front face 18. A mounting plate 19 having a slot aperture 20 and a circular opening 21 affixes to the periphery of face 18. An electrical timer clock 22 is mounted in opening 21. A modified toggle switch 11 is contained in housing 17, wherein the toggle lever 23 extends outward through aperture 20. The flat spring 24 is affixed permanently to one terminal 25 of switch 11. The free end 26 of spring 24 can be opened and closed onto the second terminal 48 of switch 11. A generally horizontal non-conductive flange arm 27 is affixed perpendicularly to spring 24, wherein arm 27 extends backwards towards the back longitudinal face 28 of housing 17. The free end 29 of arm 27 is formed from a magnetic substance. Electromagnet 16 is contained within housing 17 and communicates with magnetic end 29 of arm 27. When electromagnet 16 is activated, arm 27 and spring 24 are pulled toward back face 28 of housing 17 opening switch 11, causing the electrical flow to light 13 and timer clock motor 12 to cease. Electromagnet 16 is activated when timer clock switch 15 is closed. When timer clock switch 15 is reopened, electromagnet 16 is deactivated allowing spring 24 to engage terminal 48 which closes switch 11. Closed switch 11 allows electricity to flow to light 13 and timer clock motor 12. The electrical timer clock 22 as shown in FIGS. 1–3 comprises a generally rectangular shaped casing 31, an enclosed electric motor 12, a gear train assembly 32, and a hollow rotatable shaft 33 communicating with the gear train assembly 32, wherein the rotatable shaft 33 extends outward through a center hole 34 in a rear wall 35 of a knob member 39 which is mounted for rotation in an annular collar 36 forming an open front of housing 31. The shaft 33 is force fitted into center hole 34 in order that the shaft and knob member 39 rotate as a unit. A flange 38 extending radially from knob member 39 has angularly spaced hour indicia 37 ranging from one to twelve are inscribed. An electrically conductive reference hand 40 is mounted on a horizontal shaped cylinder sleeve 41 mounted on an exposed end of a rotatable conductive rod 42 contained within shaft 33, wherein hand 40 can be manually rotated through a 360° vertical arc enabling arm 40 to point and set at any predetermined indicia 37. Hand 40 is rotated by the insertion of a key 43 with a hexagonal stem 44 into sleeve 41 as shown in FIG. 4. A lead wire 45 joins rod 42 to electromagnet 16. An electrical contact spring 47 is contained on the back face of hand 40. A clock hand 46 is mounted onto the exposed portion of shaft 33, wherein motor 12 and gear train assembly 32 rotate hand 46 through a 360° vertical arc in 24 hours. A conductive cylinder shaped sleeve 49 is mounted perpendicularly on face 35 of casing 31. Sleeve 49 engages the bottom surface of hand 46, wherein sleeve 49 is joined to the power source 14 by a second lead wire 50. Hands 40, 46 are aligned, the switch 15 is closed allowing electromagnet 16 to be activated. The clock 22 can be reactivated for a new period of time without moving hand 46 back to the number 12 indicia by the rotation of knob member 39 within sleeve 36.

Since obvious changes may be made in the specific embodiment of the invention described herein, such modifications being within the spirit and scope of the invention claimed, it is indicated that all matter contained herein is intended as illustrative and not limiting in scope.

Having thus described the invention what I claim as new and desire to secure by Letters Patent of the United States is:

1. An electrical timing system comprising: a rectangular housing recessed within a building wall; a cover plate mounted on said housing; a toggle switch mounted in said housing including a pivotly mounted toggle lever extending outward through a first aperture in said cover plate, said toggle switch further including a first resilient elongated contact element normally engaging a second fixed contact element, said toggle lever having a surface engaging said first contact element for selectively urging said first contact element out of engagement with said second contact element in response to pivotal movement of said toggle lever; said first and second contact elements lying in a series circuit with an electric power line for controlling electrical supply in said building; an electrical clock means mounted through a second aperture in said cover plate; said clock means carrying first and second electrically conductive hands respectively radiating from first and second independently rotatable coaxial shafts; an electric motor energized from said power line and coupled for rotating said first shaft at a predetermined rate of revolution whereby said first and second hands may come into alignment at some predetermined time; said first and second hands being adapted to contact each other when aligned thereby forming a switch means; an electromagnet within said housing forming a series combination with said switch means; said series combination being connected across said power line; a magnetic member carried by said resilient first contact element of said toggle switch; said electromagnet being positioned to attract said magnetic member for flexing said first contact element out of engagement with said second contact element and means for manually rotating said second shaft for setting said predetermined time.

2. The system of claim 1 wherein said manually rotating means comprises a hexagonal socket formed at outwardly extending end of said second shaft and a turn key configured for engagement in said socket.

* * * * *